US008459263B2

(12) United States Patent
Reynolds

(10) Patent No.: US 8,459,263 B2
(45) Date of Patent: Jun. 11, 2013

(54) PRESSURE ACTIVATED DEVICE AND BREATHING SYSTEM

(75) Inventor: Daniel Reynolds, Devon (GB)

(73) Assignee: Cambridge Dive Systems Limited, Devon (GB)

( * ) Notice: Subject to any disclaimer, the term of this patent is extended or adjusted under 35 U.S.C. 154(b) by 1054 days.

(21) Appl. No.: 12/374,586

(22) PCT Filed: Jul. 19, 2007

(86) PCT No.: PCT/GB2007/002737

§ 371 (c)(1),
(2), (4) Date: Mar. 26, 2009

(87) PCT Pub. No.: WO2008/012509

PCT Pub. Date: Jan. 31, 2008

(65) Prior Publication Data

US 2009/0250062 A1 Oct. 8, 2009

(30) Foreign Application Priority Data

Jul. 22, 2006 (GB) ..... 0614574.2
Jul. 24, 2006 (GB) ..... 0614657.5

(51) Int. Cl.
*A62B 9/02* (2006.01)

(52) U.S. Cl.
USPC ..... 128/205.24; 128/205.12; 128/204.26

(58) Field of Classification Search
USPC ..... 128/205.11, 205.14, 205.12, 200.24, 128/204.26
See application file for complete search history.

(56) References Cited

U.S. PATENT DOCUMENTS 3,556,098 A 1/1971 Kanwisher et al.
3,875,957 A * 4/1975 Veit et al. ..... 137/81.1

(Continued)

FOREIGN PATENT DOCUMENTS

CH 342 106 10/1959
CN 1571687 A 1/2005

(Continued)

OTHER PUBLICATIONS

Japanese Office Action for corresponding Japanese Application No. 2009-521329 dated Apr. 4, 2012.

(Continued)

*Primary Examiner* — Lynne Anderson
*Assistant Examiner* — Bradley Philips
(74) *Attorney, Agent, or Firm* — Renner, Otto, Boisselle & Sklar, LLP

(57) ABSTRACT

A pressure activated device for controlling the supply of a gas and a breathing system for underwater use incorporating the device are provided. The device comprises an input port (64) for connection to a pressurised gas supply, an output port (66), a chamber (62) and a pressure monitoring port (66). Flow control means are provided for selectively opening a fluid path (65) outside the chamber between the input port and the output port when the ambient pressure is higher than the pressure in the chamber by a more predetermined amount. Reset means (80) selectively open a fluid path (84, 92) between the pressure monitoring port and the chamber, when the pressure at the pressure monitoring port is higher than the ambient pressure by more than a predetermined amount. The device may be used to control the supply of diluent gas to an underwater breathing system, or to maintain the volume of a flexible enclosure substantially constant, irrespective of variations in the ambient pressure.

30 Claims, 7 Drawing Sheets

U.S. PATENT DOCUMENTS

| | | | | |
|---|---|---|---|---|
| 4,219,017 | A | 8/1980 | Burr et al. | |
| 4,253,455 | A | 3/1981 | Netteland | |
| 4,616,645 | A | 10/1986 | Pedersen et al. | |
| 6,715,488 | B1 | 4/2004 | Matsuoka | |
| 7,628,152 | B2 * | 12/2009 | Patterson et al. | 128/204.26 |

FOREIGN PATENT DOCUMENTS

| | | | |
|---|---|---|---|
| EP | 0 615 899 | | 9/1994 |
| EP | 0 937 640 | | 8/1999 |
| GB | 2 340 760 | | 3/2000 |
| JP | 50-85097 | A | 7/1975 |
| JP | 55-024096 | A | 2/1980 |
| JP | 61-271198 | A | 12/1996 |
| JP | 2001-088780 | A | 4/2001 |
| WO | 03/033076 | A1 | 4/2003 |

OTHER PUBLICATIONS

International Search Report for corresponding Application No. PCT/GB2007/002737 mailed Nov. 14, 2007.

Chinese Office Action for corresponding Chinese Application No. 200780035022 dated Mar. 29, 2011.

* cited by examiner

PRESSURE ACTIVATED DEVICE AND BREATHING SYSTEM

FIELD OF THE INVENTION

The present invention relates to a pressure activated device and a breathing system for underwater use. In particular, the device is suitable for use in such a breathing system.

BACKGROUND TO THE INVENTION

A common form of underwater breathing apparatus is the open circuit type, an example of which is illustrated in FIG. 1. The user inhales from a cylinder 2 of compressed air (or other breathable gas) via an automatic demand valve 4 having a mouthpiece 6. The demand valve includes a flexible diaphragm 8 exposed to ambient pressure on one side and the mouthpiece on the other side, such that the pressure reduction at the mouthpiece caused by inhalation by the user deflects the diaphragm towards the mouthpiece. This urges the diaphragm against a lever 10, deflection of which opens a valve 12, thereby allowing air to flow from the cylinder 2 to the user. The user simply exhales to the environment via an exhaust valve 14.

Although simple and robust, an open circuit system of the type shown in FIG. 1 has numerous disadvantages, including:

- short and uncertain endurance, reduced further by increases in depth and/or breathing rate;
- massive wastage of breathing gas, requiring user to carry a large and heavy cylinder (80% of air is unwanted nitrogen and only a small proportion of the oxygen content inhaled is actually used);
- nitrogen is absorbed into the blood at depth, leading to narcosis and a risk of decompression sickness;
- air from the tank is dry and cold, dehydrating and chilling the diver.

An alternative to the open circuit type of system shown in FIG. 1 is a closed circuit rebreather, in which the exhaled gas is scrubbed of carbon dioxide, captured in a bag, replenished with oxygen and returned to the user. An early example of such a system is shown in FIG. 2. The system defines a breathing loop and includes one-way valves 20 and 22 at the mouthpiece 24 which only allow gas to flow one way around the loop. Exhaled gas passes through a carbon dioxide scrubber 26 into a breathing bag or counterlung 28. When the user inhales, this reduces the pressure in the loop, causing automatic demand valve 30 to open, allowing gas to flow from a compressed oxygen cylinder 32 into the counterlung 28.

In comparison to the open circuit system of FIG. 1, the closed circuit arrangement of FIG. 2 is relatively compact and light, as an endurance of several hours is possible regardless of breathing rate using a relatively small oxygen cylinder. The gas in the loop is warmed by the user and there is a stealthy lack of bubbles.

A problem with the system of FIG. 2 is that, beyond a certain ambient pressure, oxygen itself becomes toxic to the body, giving rise to symptoms similar to an epileptic fit. Different people have different susceptibility to this, and so the use of pure oxygen is only safe at depths of less than six meters. To safely go deeper, it is necessary to dilute the oxygen with some other gas such as air.

More recent developments in this field led to a fully closed circuit mixed gas rebreather, as exemplified by the system of FIG. 3. A supply of oxygen to the breathing loop is maintained via a control device 34. This control may be provided electronically, for example by placing oxygen sensors such as fuel cells in the loop. Should their output voltage drop below a preset level, an electric valve in control device 34 opens to inject a burst of oxygen. Alternatively, control device can simply provide a steady feed of oxygen, of the order of one liter per minute. In that case, the control device may be in the form of a small orifice, made from ruby for example. The oxygen in the breathing loop is diluted by gas from a cylinder 36 of a suitable compressed diluent gas. The diluent gases typically used in underwater breathing systems are air or an oxygen/helium mix, for example. This gas is fed to the loop via automatic demand valve 30.

As the user swims deeper, and the gas in the loop is compressed by the surrounding water pressure, the volume of counterlung 28 is topped up by the diluent gas, allowing the diver to take a full breath. Thus, the user is given a high percentage of oxygen at the water's surface, becoming more dilute with depth.

However, the safety record of systems of the form shown in FIG. 3 is poor, the main cause of these accidents being hypoxia (that is, insufficient oxygen) as a result of the system becoming incapable of supplying the diver with sufficient oxygen. This can occur through a failure in the system (such as a blocked orifice, empty tank or flat battery), user error (for example accidentally turning off the oxygen supply), or challenging circumstances such as high levels of exertion, rapid ascent from depth (though the percentage of oxygen stays the same, the concentration drops as the gas expands), panic (heavy breathing and exhalation through the nose) or a combination of these factors. When oxygen is used up faster than it can be replaced, the breathing loop volume drops, as the carbon dioxide produced is removed by the scrubber, the user cannot inhale fully and the automatic demand valve is actuated, replacing the "missing" oxygen with air. As what little oxygen in this air is used up too, the cycle repeats itself, and the mixture rapidly becomes incapable of supporting life. Furthermore, without the presence of carbon dioxide (the stimulus for feeling out of breath), the diver is unaware of there being a problem.

SUMMARY OF THE INVENTION

The present invention provides a pressure activated device for controlling the supply of a gas, comprising:

- an input port for connection to a pressurised gas supply;
- an output port;
- a chamber;
- a pressure monitoring port;
- flow control means for selectively opening a fluid path outside the chamber between the input port and the output port when the ambient pressure is higher than the pressure in the chamber by more than a predetermined amount; and
- reset means for selectively opening a fluid path between the pressure monitoring port and the chamber when the pressure at the pressure monitoring port is higher than the ambient pressure by more than a predetermined amount.

Such a device may form the diluent supply controller of a breathing system as described below.

Preferably, the output port also forms the pressure monitoring port.

In a preferred embodiment, the flow control means comprises a control valve for selectively opening the fluid path between the input port and the output port, and pressure sensitive means coupled to the control valve so as to open the control valve when the ambient pressure is higher than the pressure in the chamber by more than a predetermined amount.

The pressure sensitive means may be in the form of a flexible diaphragm or a piston, for example.

The reset means may comprise reset pressure sensitive means responsive to a difference between ambient pressure and the pressure at the pressure monitoring port, and reset valve means, the reset pressure sensitive means being coupled to the reset valve means such that when the pressure at the pressure monitoring port is higher than the ambient pressure by more than a predetermined amount, the reset valve means opens the fluid path between the pressure monitoring port and the chamber.

Additional reset means may be provided comprising additional reset pressure sensitive means responsive to a difference between ambient pressure and the pressure in the chamber, and additional reset valve means, the additional reset pressure sensitive means being coupled to the additional reset valve means such that when the pressure within the chamber is higher than the ambient pressure by more than a predetermined amount, the additional reset valve means opens to vent gas from the chamber. The reset valve means may open the chamber and the output port, for example, or may vent the chamber to the ambient environment, or to the pressure monitoring port.

In a preferred embodiment, the reset means and additional reset means referred to above have common components. In particular, their pressure sensitive means and reset valves may be provided by the same components, and the reset valve means selectively opens a fluid path between the pressure monitoring port and the chamber, when either the pressure in the chamber or at the pressure monitoring port exceeds ambient pressure.

More preferably, the reset pressure sensitive means, the additional reset pressure sensitive means, the reset valve means, and the additional reset valve means comprise a common flexible closure. The flexible closure may be exposed to ambient pressure on one side, and is moveable between a closed position and an open position to selectively open the fluid path from the chamber.

According to a further preferred embodiment, when the flexible closure is in its closed position, a first portion of its other side is exposed to the pressure at the pressure monitoring port, and a second portion is exposed to the pressure in the chamber. Advantageously, the area of the first portion is greater than the area of the second portion. With this configuration, more pressure is required to lift the flexible closure to vent the chamber than when equalising the output port and chamber pressures, preventing unnecessary cycles of resetting and activation with small changes in ambient pressure.

A pressure activated device of the form described herein may be provided in combination with an enclosure in order to maintain the enclosure's volume substantially constant, irrespective of variations in the ambient pressure. Suitable applications may for example be in association with a buoyancy control device, a lifting bag, or a submarine's trim tank. Dry land applications may include hyperbaric chambers, for example. An overpressure valve may be provided together with the enclosure to reduce the internal pressure as the ambient pressure reduces.

The present invention further provides a breathing system comprising:

- means for removing carbon dioxide from gas in the enclosure;
- a mouthpiece port;
- an oxygen port for supplying oxygen gas to the enclosure; and
- a diluent port connected to the output port of a pressure activated device as defined above.

Thus, when the system is used underwater, diluent gas is added to the volume of gas within the enclosure in response to increases in ambient pressure. This enables the system to maintain a stable partial pressure of oxygen at depth, regardless of user activity. The system combines the gas efficiency of a closed circuit re-breather system with robust simplicity.

The enclosure volume is maintained by the diluent supply controller, which injects diluent in direct response to increases in depth, and is insensitive to any suction created by the user. Supplying diluent gas to the system in this manner minimises any risk of shallow water blackout, breathing down the enclosure volume, or other causes of hypoxia.

In a preferred embodiment, a common inlet port acts as both the oxygen port and the diluent port.

Preferably, the enclosure is in the form of a loop. In that case, the carbon dioxide removing means may be located in the flow path defined by the loop, so that as exhaled air circulates round the loop, it passes through the carbon dioxide removing means and carbon dioxide present is absorbed.

The system may include means for feeding a substantially constant supply of oxygen from a compressed oxygen supply to the oxygen port. In this case, if oxygen fails to be supplied to the enclosure for some reason, this results in a drop in the enclosure volume. The user is therefore unable to take a full breath, giving a highly noticeable warning that something is wrong. The diver can then react by actuating means for enabling a user to allow oxygen into the enclosure (for example through the oxygen port if provided), or by switching to a backup breathing system, fixing whatever caused the problem, or by simply ending the dive.

Alternatively, the system may include means for feeding oxygen to the oxygen port when the pressure in the enclosure falls below ambient pressure by more than a predetermined amount. Thus, when there is a drop in the enclosure volume and the user is unable to take a full breath, the suction created in this event will automatically trigger injection of oxygen by the oxygen feeding means. Thus, oxygen is added in response to volume depletion, via an automatic demand valve for example. In this embodiment, the needs for oxygen and air are therefore distinguished and automatically responded to.

The supply of oxygen on demand allows for a substantially constant level of oxygen to be maintained irrespective or user work rate without electronic input. Instead, it relies on mechanical cues from ambient pressure and user oxygen consumption.

The ability to provide such a system without the need for electronics is beneficial as such systems are sometimes unused for years at a time, during which batteries may run down and sensors degrade.

If the system does include some electronic components, the present invention allows key aspects to be implemented mechanically, allowing continuation of diving in the event of electronic failure. It may therefore provide a reliable backup for an electronic control system which is gas efficient even during heavy exertion.

In an alternative configuration the output of the pressure sensitive diluent valve may be directed to an automatic demand valve also used to supply oxygen. Thus, it being provided that the supply of diluent is at a higher pressure than the supply of oxygen, activation of the pressure sensitive diluent valve during a descent would cause diluent to be supplied through the automatic demand valve instead of oxygen, whilst oxygen would still be supplied through the automatic demand valve while at constant depth or ascending. This may allow more accurate regulation of enclosure volume in the breathing system. By this means a pressure activated device of this form may be used as a means to switch a gas input to a second device from one source to another.

In preferred embodiments, the enclosure is in the form of a loop including valve means which only allow gas to flow one way around the loop. It is preferable to provide the oxygen port upstream of the carbon dioxide removing means and downstream of the mouthpiece port. Similarly, it is preferable to provide the diluent port downstream of the carbon dioxide means and upstream of the mouthpiece port. These configurations minimise inappropriate activation of either gas supply due to pressure differentials in the enclosure caused by gas flow around the loop.

In some cases, means for sensing the partial pressure of oxygen in the enclosure may be provided, in the form of oxygen fuel cells, for example. The may be combined with a display for indicating the sensed partial pressure and/or means for alerting a user when the measured partial pressure falls below a predetermined threshold.

As noted above, means may be provided for enabling a user to inject oxygen into the enclosure. Accordingly, the user can manually cause oxygen to be supplied into the enclosure when alerted to a deficiency thereof.

In the breathing system and pressure activated devices described above, respective adjustment means may be provided for adjusting the pressure differential (the "predetermined amount" referred to above) associated with one or more pressure sensitive means. For example, the associated valves may be biased towards their closed position by spring means, and the adjustment means may operate to alter the tension of the respective springs.

BRIEF DESCRIPTION OF THE DRAWINGS

Known arrangements and embodiments of the invention will now be described by way of example with reference to the accompanying schematic drawings, wherein.

DETAILED DESCRIPTION OF THE DRAWINGS

Figure 1:
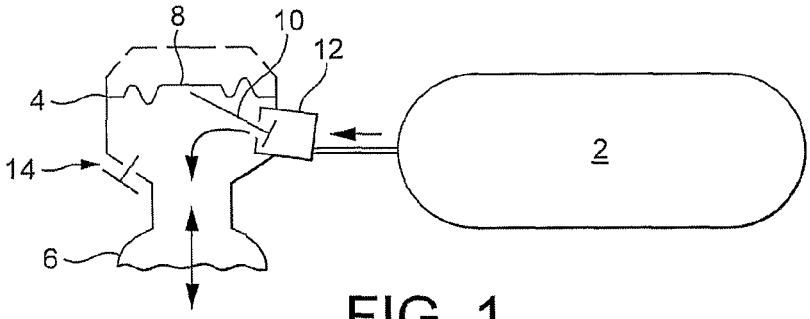
FIG. 1 Conventional Art
FIG. 1 shows a known open circuit breathing system.
Figure 2:
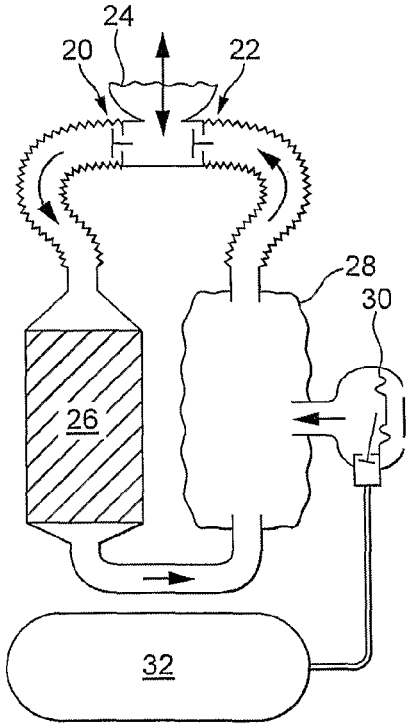
FIG. 2 Conventional Art
FIG. 2 shows a known oxygen-only closed circuit breathing system.
Figure 3:
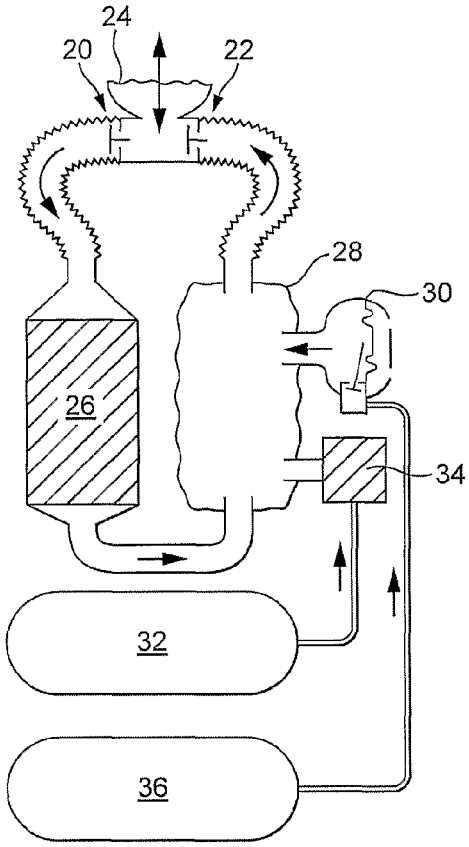
FIG. 3 Conventional Art
FIG. 3 shows a known closed circuit mixed gas breathing system.

All of the Figures are diagrammatic and not drawn to scale. Relative dimensions and proportions of parts of the drawings have been shown exaggerated or reduced in size, for the sake of clarity and convenience in the drawings. The same reference signs are generally used to refer to corresponding or similar features in modified and different embodiments.

Figure 4:
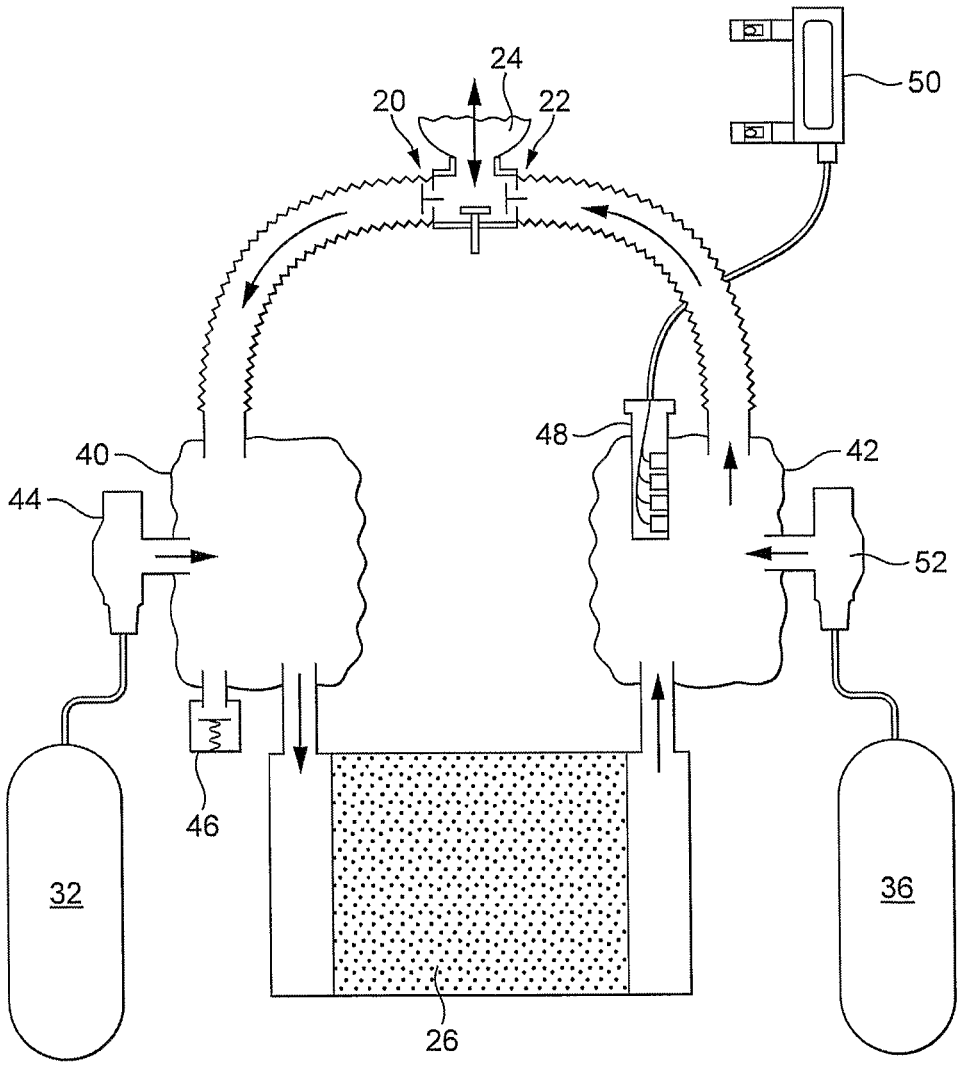
FIG. 4 shows a breathing system according to an embodiment of the invention.

A breathing system embodying the present invention is shown in FIG. 4. It defines an enclosure in the form of a loop. From mouthpiece 24, exhaled gas is able to pass through one-way valve 20 into an exhale counterlung 40. It then passes through carbon dioxide scrubber 26 into an inhale counterlung 42. The flow path then returns back to the mouthpiece via one-way valve 22. The counterlungs should preferably have a low aspect ratio.

Oxygen is fed to the enclosed breathing loop via a port in the sidewall of the exhale counterlung 40. This supply is controlled by an oxygen supply controller 44. In the embodiment illustrated, this is in the form of an automatic demand valve which responds to a reduction in pressure in the exhale counterlung relative to the ambient pressure by injecting oxygen into the counterlung 40. Oxygen supply controller 44 may instead, or additionally feed oxygen from the compressed supply in cylinder 32 under electronic control as discussed further below, or at a constant feed rate, typically around 1 liter per minute. This feed rate may be adjusted according to the needs of a particular user.

An overpressure valve 46 is also provided in association with exhale counterlung 40. It is provided to allow gas to escape from the breathing loop when the pressure is more than the predetermined amount above the ambient pressure. The provision of such a valve is optional. Alternatively, excess gas pressure may instead be vented via the user's nose, for example.

A gas sensor 48 extends into the inhale counterlung 42 to monitor properties of the gas being inhaled from that counterlung. The sensor may monitor the composition of the gas, and in particular the partial pressure of oxygen. It may be employed to activate injection of oxygen into the breathing loop should the partial pressure of oxygen fall below a preset level. The gas sensor may be coupled to a display handset 50 to display information for the user, to enable the user to monitor the gas composition. The user may be able to manually control the gas composition. Preferably, the sensor comprises two or more identical, independent sensors (and preferably three or more), enabling the user (or an electronic monitor) to recognise if an individual sensor is malfunctioning.

Diluent gas is fed to the inhale counterlung via a port defined in its wall. This supply is regulated by a diluent supply controller 52. This controller is sensitive to the ambient pressure and the pressure in a chamber within the controller. It is arranged to allow diluent gas to flow into the inhale counterlung when the ambient pressure is higher than the pressure within the chamber by more than a predetermined amount.

In this way, the diluent supply controller 52 maintains a substantially constant volume of gas within the breathing loop as the ambient pressure increases. This controller is in the form of a pressure activated device embodying the present invention.

Figure 5:
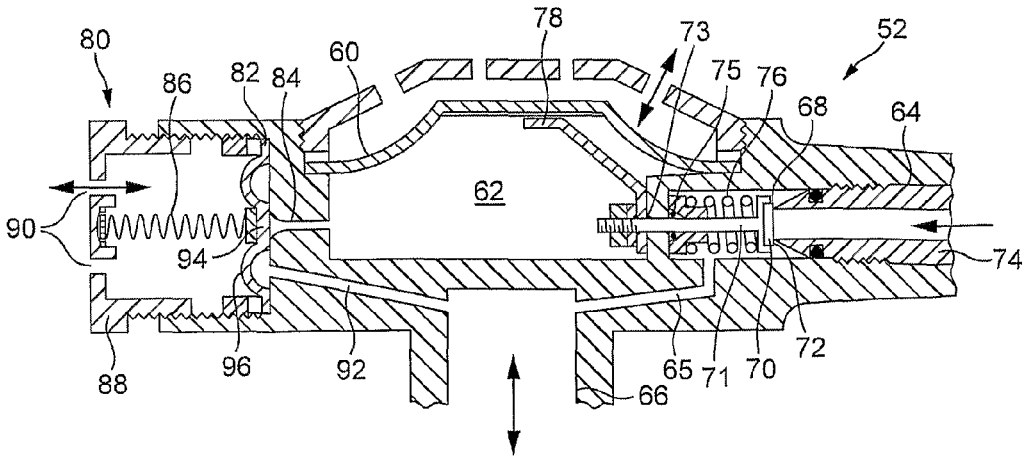
FIG. 5 shows a cross-sectional view of a first embodiment of a pressure activated device according to the present invention.

A cross-sectional view of a pressure activated device according to the present invention, which is suitable for use as the diluent supply controller 52 of FIG. 4, is shown in FIG. 5.

A flexible diaphragm 60, in combination with the body of the device 52, defines a chamber 62. The device has an input port 64 and a combined output and pressure monitoring port 66. A valve 68 is operable to open or close a fluid path (which includes conduit 65) between input port 64 and output port 66. The valve includes a valve closure 70 which rests against a valve seat 72, which in FIG. 5 is provided by gas feed 74. The valve closure 70 is biased towards its closed position by a spring 76.

Valve closure 70 includes an elongate stem 71 which passes through an opening 73 in an internal wall of the device 52 into chamber 62. This opening 73 should not permit gas flow into or out of chamber 62. In FIG. 5, this is ensured by an annular seal 75.

When the ambient pressure exceeds that within chamber 62, the diaphragm 60 is urged inwardly. The diaphragm in turn acts on a lever 78, which is coupled to the end of the valve closure stem 71. Sufficient pressure on the lever overcomes the spring tension of spring 76, lifting the valve closure 70 from its seat 72, and allowing gas to flow from a compressed supply coupled to input port 64, through conduit 65 to output port 66.

Device 52 also includes reset means 80. This comprises a valve formed by a flexible circular closure or member 82. The device body defines a fluid path between chamber 62 and the reset means 80, in the form of an orifice 84. Flexible member 82 is biased against the outer end of orifice 84 by a spring 86. The compression of spring 86 may be adjusted by changing the position of spring retaining member 88 which engages the outer end of the spring 86. In the embodiment shown in FIG. 5, retaining member 88 is coupled to the body of device 52 by a screw thread enabling the compression of spring 86 to be altered by rotating returning member 88. The compression in spring 86 governs the volume of gas within the breathing loop or enclosure.

The interior volume defined by the reset means is in fluid communication with the ambient surroundings via openings 90 in the retaining member 88. Thus, flexible member 82 is exposed to ambient pressure on one side and the pressure in the chamber 62 over a portion of its other side, via orifice 84. The body of pressure activated device 52 also defines a fluid path extending from output port 66 to the interior of reset means 80, in the form of a passage 92. Flexible member 82 extends over the end of the passage 92 which opens into the interior volume of the reset means 80. Accordingly, flexible member 82 is also exposed to the pressure at the combined output and pressure monitoring port 66 at its inner surface.

As noted herein, a pressure activated device embodying the present invention has a number of applications in which it is operable to keep the volume of a flexible enclosure substantially constant irrespective of changes in the ambient pressure. By way of illustration, its operation when employed as a diluent supply controller 52 in a breathing system of the type depicted in FIG. 4 will now be described with reference to FIGS. 6 to 9.

Figure 6:
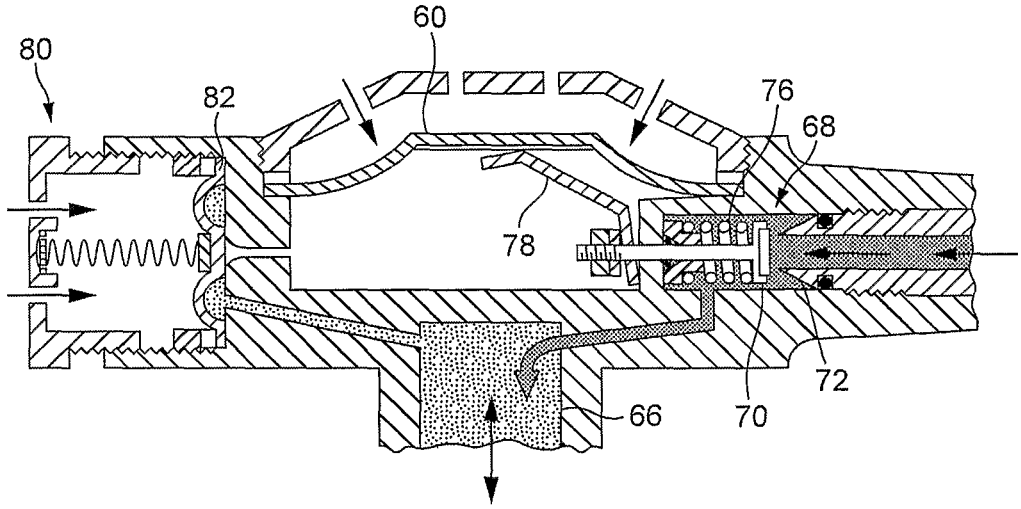
FIGS. 6 to 9 show successive stages in a sequence of operation of the device shown in FIG. 5.

As a diver descends, the ambient pressure increases pushing diaphragm 60 inwards. This causes the diaphragm to depress lever 78, opening valve 68, allowing diluent to enter the breathing loop via output port 66, as shown in FIG. 6. The size of the pressure differential between ambient pressure and that in chamber 62 which is required to activate the valve is governed by the surface area of the diaphragm 60 and can be adjusted by varying the spring tension of spring 76. At this stage, the ambient pressure is greater than that in either chamber 62 or at output port 66, and so the flexible member 82 of the reset means 80 is in its closed position.

Figure 7:
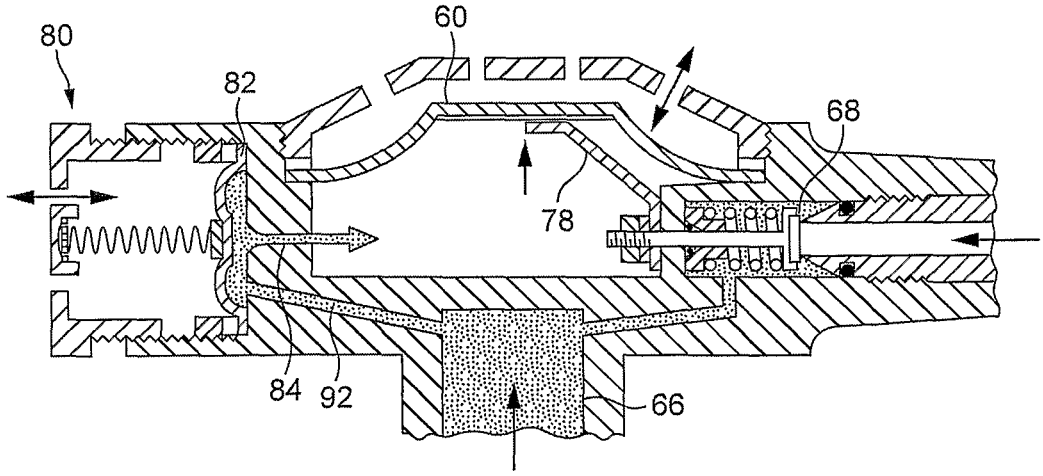

As diluent gas flows into the breathing loop, the pressure at output port 66 increases. Ultimately, as shown in FIG. 7, the pressure at output port 66 exceeds ambient pressure sufficiently to lift flexible member 82 from orifice 84, thereby forming an open fluid path from the output port to chamber 62. As the pressure at the output port is greater than ambient, this pushes flexible diaphragm 60 outwardly, allowing lever 78 to rise and in turn close valve 68, preventing further injection of diluent gas.

Figure 8:
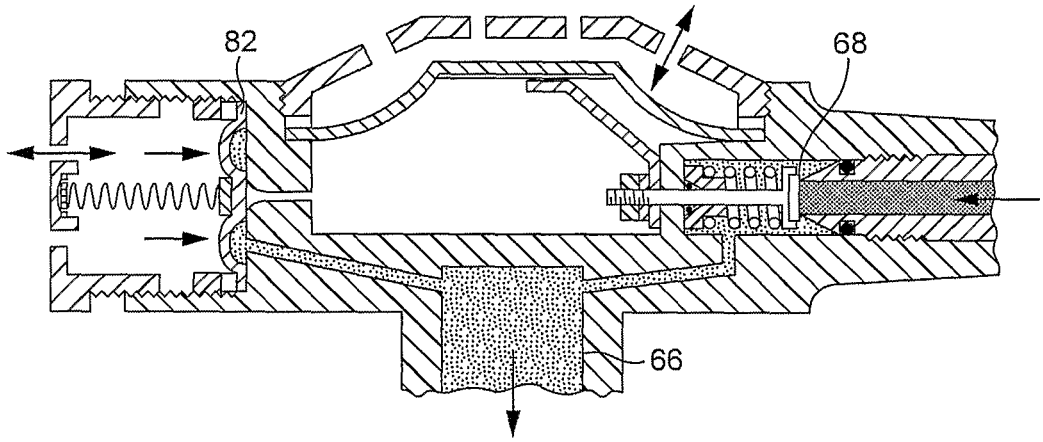

As oxygen is consumed by a user and carbon dioxide absorbed by the carbon dioxide scrubber, the volume of gas in the breathing loop decreases. The user is therefore unable to take a full breath, and so upon inhaling, causes a drop in pressure in the breathing loop relative to ambient. This situation is illustrated in FIG. 8. As the pressure at output port 66 is below ambient, flexible member 82 seals orifice 84 preventing this reduced pressure causing a similar reduction in pressure in the chamber 62, preventing inappropriate injection of diluent to replace oxygen.

The pressure differential between the breathing loop and ambient may though activate a demand valve acting as oxygen supply controller 44 to replenish oxygen levels in the breathing loop.

Figure 9:
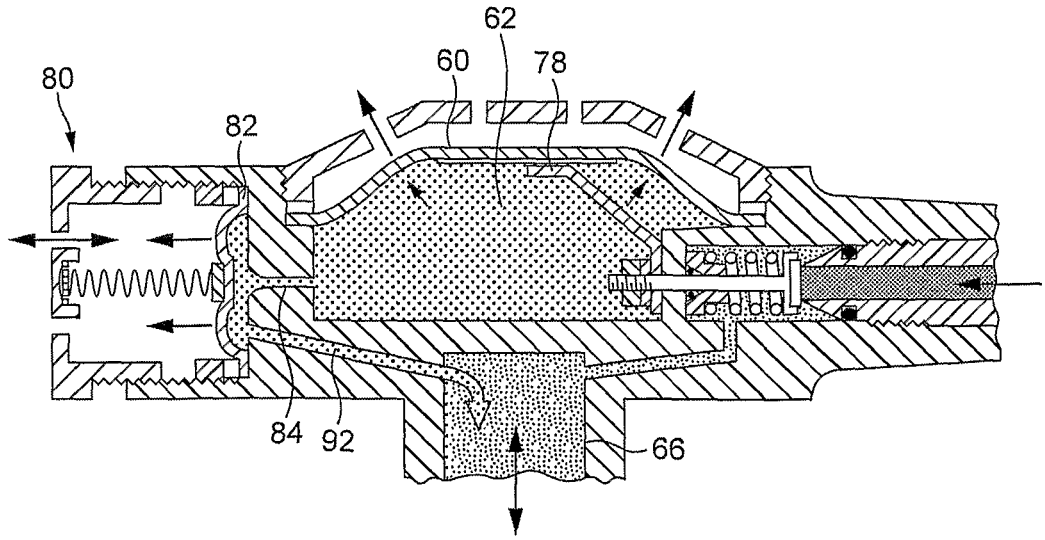

During a diver's ascent, the ambient pressure falls, the gas in chamber 62 expands and lifts flexible member 82 away from the outer end of orifice 84, venting the chamber 62, in this case to the breathing loop via orifice 84 and passage 92. This is shown in FIG. 9. Excess gas within the breathing loop may be vented elsewhere in the system, for example via the user's nose or an overpressure valve 46 if included.

In the embodiment of pressure activated device 52 shown in FIGS. 5 to 9, flexible member 82 comprises a planar, central region 94, surrounded by an annular profiled portion 96 (as indicated in FIG. 5). Central region 94 forms a valve closure over the outer end of orifice 84. When region 94 is in its closed position, annular region 96 is domed away from the outer surface of the body of device 52. In particular, it may form a shape corresponding substantially to part of the surface of a toroid. Annular portion 96 extends over the outer end of passage 92. The relative dimensions of orifice 84, passage 92 and flexible member 82 are preferably selected such that the flexible member 82, in its closed position, exposes a significantly larger surface area to the pressure at output port 66 via passage 92 than it exposes to the pressure in chamber 62 via orifice 84. It is arranged such that more pressure is required in the chamber 62 to lift the flexible member than at the combined output and pressure monitoring port 66 when resetting the system on filling the lungs, preventing unnecessary cycles of resetting and activation with small changes in depth.

Figure 10:
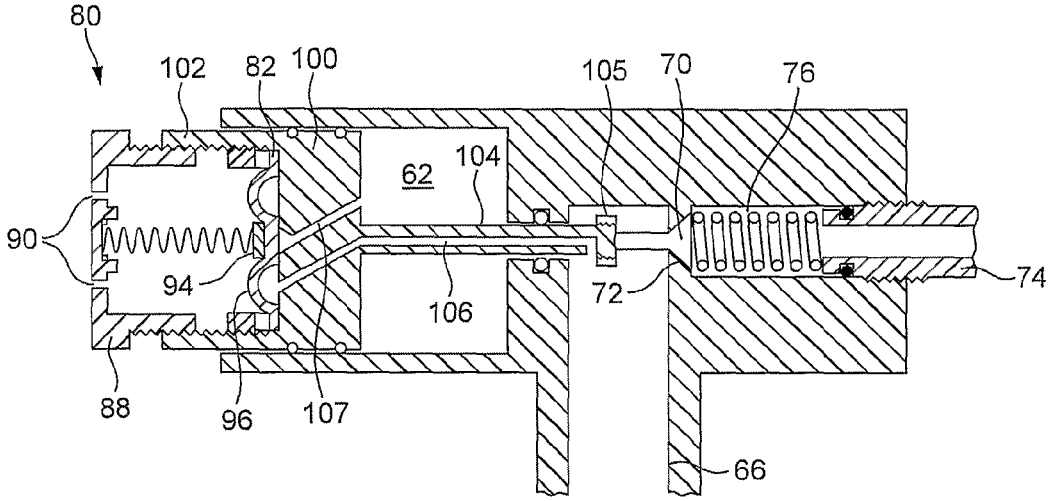
FIGS. 10 and 11 show cross-sectional views of second and third embodiments respectively of a pressure activated device according to the invention.

Another embodiment of the pressure activated device shown in FIG. 5 is illustrated in FIG. 10. In place of flexible diaphragm 60, a piston 100 is provided, comprising a piston head 102 and a piston rod 104. The outer end of the piston head is exposed to ambient pressure, and its inner end exposed to the pressure of chamber 62.

Valve closure 70 is engaged by the end of piston rod 104. A stop 105 is provided at the end of the piston rod which defines the maximum outward displacement of the piston. Alternatively, the valve closure 70 may be mounted onto the end of the piston rod, and thereby act as the limiting stop for the piston. The valve closure is biased against a valve seat 70 defined by the body of the device 52 by a spring 76. The outer end of spring 76 engages the diluent feed 74. A channel 106 is defined through the piston rod 104, extending from the outer end of the piston head to the inner end of the piston rod. The inner end of the channel is exposed to the pressure at output port 66 and the outer end is in fluid communication with the annular portion 96 of flexible member 82. A further orifice 107 is provided which extends through the piston head, being open to chamber 62 at its inner end, and closed by the planar central region 94 of flexible member 82 at its outer end The pressure activated device illustrated in FIG. 10 is operable in a similar manner to the arrangement depicted in FIG. 5 as described above.

The embodiment of FIG. 10 advantageously allows a user to initiate diluent injection manually by depressing the outer end of piston 100. Also, it readily permits adjustment of its activation threshold by altering the position of diluent feed 74. In the FIG. 5 configuration, whilst movement of diluent feed 74 also affects this threshold, it may then be necessary to tighten the bolt retaining the lever 78 to keep it in engagement with diaphragm 6*o*. Accessing this bolt requires partial disassembly of the device, and therefore this adjustment is less convenient for the user.

The device of FIG. 10 involves fewer moving parts relative to that of FIG. 5, improving its reliability and simplifying its manufacture.

Figure 11:
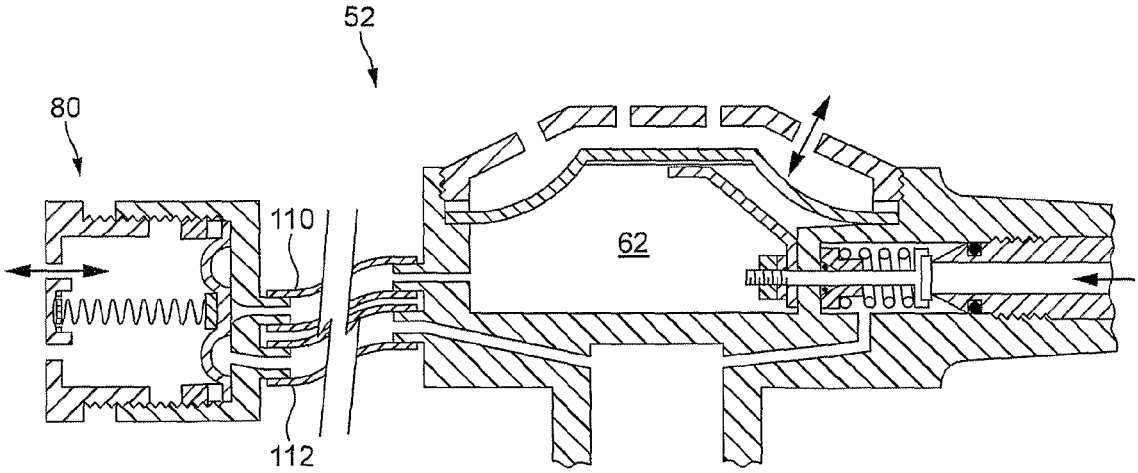

A further embodiment of a pressure activated device according to the present invention is shown in FIG. 11. It differs from the arrangement of FIG. 5 in that reset means 80 is provided separately from the main body of the device and connected via tubes 110 and 112. In this way, the reset means may be located remotely from the main body, where it can be more easily reached for adjustment by a user, for example.

Figure 12:
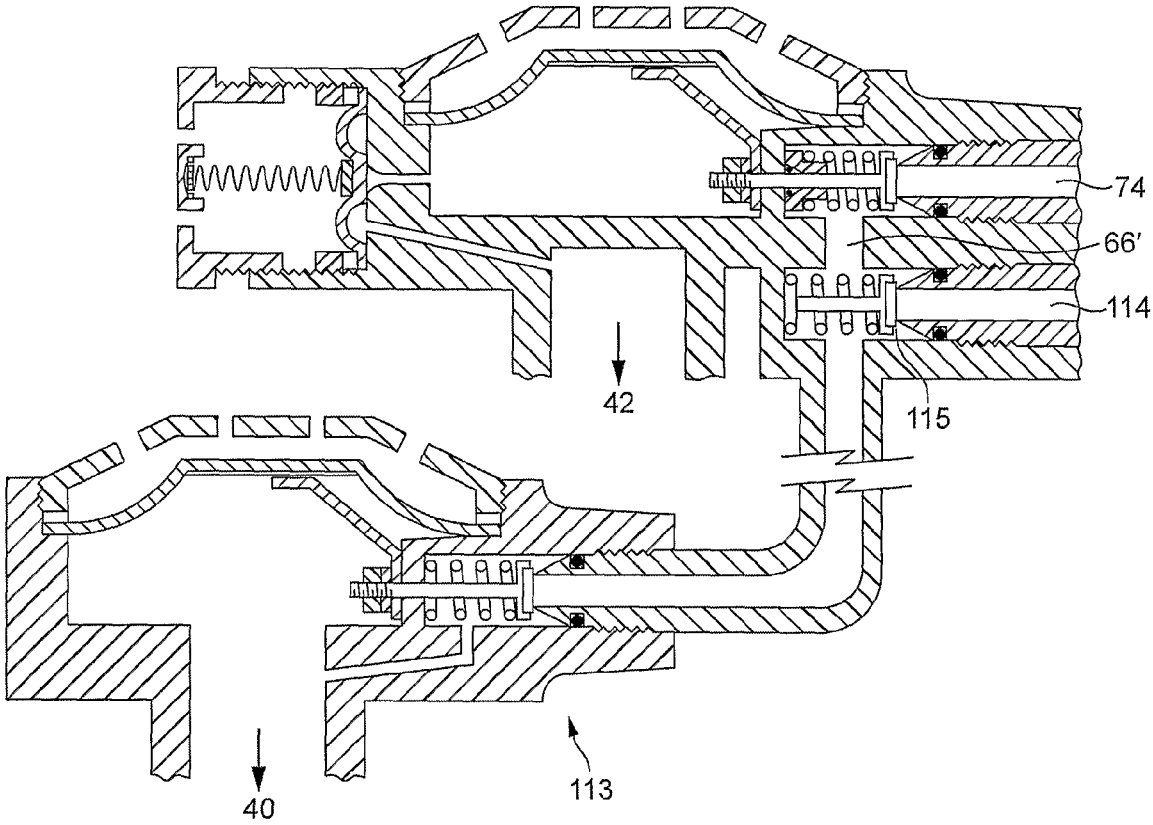
FIG. 12 shows a cross-sectional view of a fourth embodiment of a pressure activated device according to the invention.

A further embodiment of a pressure activated device according to the present invention is shown in FIG. 12. It differs from the arrangement of FIG. 5 (and FIGS. 10 and 11) in that the output port 66' is distinct from the pressure monitoring or reset port, being directed to the input of a known automatic demand valve 113, or other equivalent valve used to supply oxygen on depletion of counterlung volume.

Given that diluent supply 74 is at higher pressure than oxygen supply 114, activation of the pressure activated device as described with reference to FIG. 6 causes diluent to be supplied to the valve 113 instead of oxygen. Entry of diluent into the oxygen supply is prevented by non-return valve 115. Automatic demand valve 113 itself will be activated by the suction of the user's breathing if the movable volume of counterlungs 40 and 42 falls below that of the user's inhalation. Thus, during descent, activation of valve 113 will cause diluent to be added to fill the counterlungs, while oxygen will be added in response to volume depletion when at constant depth or ascending.

The arrangement of FIG. 12 offers more accurate control of counterlung volume than that shown in FIG. 5, as gas injection will top up the counterlungs to match the user's tidal volume.

The modifications shown in FIG. 12 may also be employed in combination with the devices shown in FIGS. 10 and 11.

The invention claimed is:

1. A pressure activated device for controlling the supply of a gas, comprising;

an input port for connection to a pressurised gas supply;

an output port fluidly connected to the input port by a first fluid path;

a chamber which is separated from the first fluid path and which is fluidly isolated from an ambient environment;

a pressure monitoring port fluidly connected to the chamber;

flow control means for selectively opening the first fluid path outside the chamber between the input port and the output port when ambient pressure is higher than the pressure in the chamber by more than a first predetermined amount; and reset means for selectively opening a second fluid path between the pressure monitoring port and the chamber when the pressure at the pressure monitoring port is higher than the ambient pressure by more than a second predetermined amount.

2. A device of claim 1 wherein the output port also forms the pressure monitoring port.

3. A device of claim 1 wherein the flow control means comprises a control valve for selectively opening the fluid path between the input port and the output port, and pressure sensitive means coupled to the control valve so as to open the control valve when the ambient pressure is higher than the pressure in the chamber by more than the first predetermined amount.

4. A device of claim 3 wherein the pressure sensitive means includes a flexible diaphragm exposed to ambient pressure on one side and the chamber on its other side.

5. A device of claim 4 wherein the pressure sensitive means is coupled to the valve by a lever which is engageable by the diaphragm.

6. A device of claim 3 wherein the pressure sensitive means includes a piston exposed to ambient pressure on one side and the chamber on its other side.

7. A device of claim 6 wherein the control valve comprises a valve closure and a valve seat, and the valve closure is mounted on the piston.

8. A device of claim 1 wherein the reset means comprises;

a reset pressure sensitive means responsive to a difference between ambient pressure and the pressure at the pressure monitoring port and;

a reset valve means, the reset pressure sensitive means being coupled to the reset valve means such that when the pressure at the pressure monitoring port is higher than the ambient pressure by more than the second predetermined amount, the reset valve means opens the fluid path between the pressure monitoring port and the chamber.

9. A device of claim 1 including additional reset comprising;

additional reset pressure sensitive means responsive to a difference between ambient pressure and the pressure in the chamber and;

additional reset valve means, the additional reset pressure sensitive means being coupled to the additional reset valve means such that when the pressure within the chamber is higher than the ambient pressure by more than a third predetermined amount, the additional reset valve means opens to vent gas from the chamber.

10. A device of claim 9 wherein the reset valve means is operable to open a fluid path between the chamber and the output port and/or between the chamber and the pressure monitoring port.

11. A device of claim 9 wherein the reset means and additional reset means have common components.

12. A device of claim 11 wherein the reset pressure sensitive means, the additional reset sensitive means, the reset valve means, and the additional reset valve means comprise a common flexible closure.

13. A device of claim 12 wherein the reset valve means is operable to open a fluid path between the chamber and the output port and/or between the chamber and the pressure monitoring port and wherein the flexible closure is exposed to ambient pressure on one side, and is moveable between a closed position and an open position to selectively open the fluid path from the chamber.

14. A device of claim 13 wherein when the flexible closure is in its closed position, a first portion of its other side is exposed to the pressure at the pressure monitoring port, and a second portion is exposed to the pressure in the chamber.

15. A device of claim 14 wherein the area of the first portion is greater than the area of the second portion.

16. A pressure activated device of claim 1 in combination with an enclosure, wherein the device is arranged to maintain the enclosure's volume substantially constant, irrespective of variations in ambient pressure.

17. A pressure activated device in combination with an enclosure according to claim 16, wherein the enclosure is defined by a buoyancy control device, a lifting bag, or a trim tank of a submarine.

18. A breathing system comprising an enclosure for containing gas to be inhaled, wherein the enclosure comprises:

means for removing carbon dioxide from gas in the enclosure;

a mouthpiece port;

an oxygen port for supplying oxygen gas to the enclosure; and a diluent port connected to the output port of a pressure activated device of claim 1 for controlling the supply of a diluent gas.

19. A system of claim 18 wherein a common inlet port acts as both the oxygen port and the diluent port.

20. A system of claim 18 wherein the enclosure forms a loop, and the carbon dioxide removing means are located in the flow path defined by the loop.

21. A system of claim 18 including means for feeding a substantially constant supply of oxygen from a compressed oxygen supply to the oxygen port.

22. A system of claim 18 including means for feeding oxygen to the enclosure when the pressure in the enclosure falls below ambient pressure by more than a third predetermined amount.

23. A system of claim 18 wherein the loop includes valve means which only allow gas to flow one way around the loop, and the oxygen port is provided upstream of the carbon dioxide removing means and downstream of the mouthpiece port.

24. A system of claim 18 wherein the loop includes valve means which only allow gas to flow one way around the loop, and the diluent port is provided downstream of the carbon dioxide removing means and upstream of the mouthpiece port.

25. A system of claim 18 including means for sensing the partial pressure of oxygen in the enclosure.

26. A system of claim 25 wherein the output of the sensing means is used to govern the injection of oxygen into the enclosure.

27. A system of claim 18 including means for enabling a user to allow oxygen into the enclosure.

28. A system of claim 18 including means for enabling a user to allow diluent into the enclosure.

29. A system of claim 18 including an overpressure valve for allowing gas to escape from the enclosure when the pressure therein exceeds a predetermined threshold.

30. A device of claim 1, wherein respective adjustment means are provided for adjusting at least one of said first or second predetermined amounts.

* * * * *